United States Patent [19]

Junker

[11] 4,119,079

[45] Oct. 10, 1978

[54] ROLLER FOR PRODUCING A PROFILE ON A GRINDING WHEEL

[76] Inventor: Erwin Junker, Talstr. 78, 7611 Nordrach, Fed. Rep. of Germany

[21] Appl. No.: 828,011

[22] Filed: Aug. 26, 1977

Related U.S. Application Data

[63] Continuation of Ser. No. 669,249, Mar. 22, 1976, abandoned.

[51] Int. Cl.[2] ..... B24B 53/06

[52] U.S. Cl. ..... 125/11 CD; 51/288

[58] Field of Search ..... 125/11 R, 11 CD; 51/287, 288; 10/152 T

[56] References Cited

U.S. PATENT DOCUMENTS

| | | | |
|---|---|---|---|
| 1,955,082 | 4/1934 | Miller | 51/287 X |
| 2,432,246 | 12/1947 | Mackmann | 51/287 X |
| 2,456,762 | 12/1948 | Wilson | 125/11 CP |
| 2,787,798 | 4/1957 | Rosan | 10/152 T |
| 2,981,038 | 4/1961 | Flanders | 125/11 R |
| 3,060,643 | 10/1962 | Wildhaber | 51/287 X |
| 3,423,879 | 1/1969 | Klomp | 51/287 X |
| 3,602,209 | 8/1971 | Bocker | 125/11 R |

*Primary Examiner*—Harold D. Whitehead

*Attorney, Agent, or Firm*—Allegretti, Newitt, Witcoff & McAndrews

[57] ABSTRACT

A profiling roller for producing a profile on a grinding wheel used in a thread grinding machine operating with longitudinal feed (along the axis of the rotating wheel) having a central finishing roller rib of size and configuration corresponding to the thread to be produced, said finishing rib being flanked with preliminary roller ribs of progressively decreasing height and width and arranged symmetrically with respect to the finishing rib toward the ends of the roller. The dimensions of the progressively smaller ribs compared with the finishing rib are geometrically defined in the specification in terms of root radii, flank angle and pitch circle radii.

6 Claims, 4 Drawing Figures

A
b
c
1
2
3
a1
a2
a3
R1
R2
R3
α1
α2
α3
x1
x2
y1
y2
z1
z2
t

A
x1
x2
t
R3
R2
R1
α3
α2
α1
P
a3
a2
a1
z1
z2

B
1
2
3
4
5

ROLLER FOR PRODUCING A PROFILE ON A GRINDING WHEEL

This is a continuation of Ser. No. 669,249 filed Mar. 22, 1976 now abandoned.

BACKGROUND OF THE INVENTION - PRIOR ART

The invention relates to a profiling roller for producing a profiled grinding wheel for a thread grinding machine working with longitudinal feed, having at least one finishing roller rib in the center of the roller, with a flank angle, root radius, depth of thread and pitch circle radius corresponding to the thread to be produced, and modified preliminary roller ribs with decreasing rib height arranged symmetrically in relation to both ends of the roller.

In known rollers for the rolling of thread profiles in grinding wheels of thread grinding machines operating with longitudinal feed, the profile is so arranged that each of the ribs have a uniform angle, which corresponds to the flank angle of the workpiece to be ground. Furthermore the ribs are so graduated in height that the height of successive ribs increases from one end of the roller to the other so that the ribs located at the terminus have a height which corresponds to the finished thread profile. In this structure the adjacently located smaller ribs take over the function of the preliminary roller, so that the excavated material is shared between the individual ribs. As a rule three different heights of rib are arranged for preliminary rollers, increasing in height from one end of a roller to the other, and for finishing grinding two or three ribs with uniform height are provided.

These known profiling rollers have the marked disadvantage that they can only be used for grinding in one direction. Furthermore in these known rollers, which have a uniform flank angle on all ribs, there is no possibility of selecting a radius for the teeth greater than that prescribed for the finished profile. The tooth radius is the weakest point of a profile in performing rough grinding.

In U.S. Pat. No. 2,787,798 an arrangement is disclosed in which the flank angles vary towards the rib root but are equal above the pitch circle diameter. Such a device cannot be used for rolling profiles in a grinding wheel.

THE INVENTION

The present invention is concerned with the problem of constructing a roller profile of the type described so that when used with a grinding wheel, a screw top can be produced in a simple and economical manner, and with longitudinal feed can be ground on both sides. The tool life of the grinding wheel, in contrast to known devices, is substantially increased because of the special roller profile.

This problem is solved in accordance with the invention in that a) on the modified preliminary roller ribs the root radii are progressively increased towards the ends of the roller ($R_3 > R_2 > R_1$) and the flank angle progressively diminished ($\alpha_3 > \alpha_2 > \alpha_1$) and b) the pitch circle radius of any preliminary roller ribs, relative to the pitch circle radius of the finishing roller ribs is selected progressively greater to the ends of the roller to an extent such that the spacing measured from the point of intersection of the flanks of an inner roller rib with its associated pitch circle at right angles to the corresponding flanks of the next roller rib arranged towards the end of the roller, is substantially equal to the rib height difference of neighboring roller ribs.

The active surface of the rollers is preferably furnished with diamonds.

The roller according to the invention with circular cross-section has a profile such that the breadth of the profile is determined by the pitch of the profile to be ground. This roller can be incorporated in a known rolling device, where it is driven by a motor to rotate about its own axis. In this the roller is so arranged in relation to a grinding wheel that through its presentation to the grinding wheel the profile of the roller is exactly rolled onto the periphery of the rotating grinding wheel. Since the radius of a thread profile is relatively small and the bound abrasive grains of a grinding wheel break away even with small stress, by the increase in accordance with the invention of the radii on the preliminary grinding ribs, which carry the main stress of the grinding, a greater tool life is produced, which leads to a greater operational efficiency. Also during the rolling of the profile there are created in the grinding wheel, through the different depths of rib and the different root radii in combination with the different flank angles, pockets for the supply of cooling liquid.

THE DRAWINGS

The invention is explained below in more detail with reference to an illustrative embodiment shown in the drawing. In the drawing:

FIG. 1 shows schematically the profile of a roller according to the invention wherein one finishing roller rib and two preliminary roller ribs are shown, FIG. 2*a* is a longitudinal section of a portion of the roller profile, FIG. 2*b* is a similar sectional view showing the profile of a grinding wheel produced with the roller of FIG. 2*a*, and FIG. 3 is a schematic representation of the roller of the invention, the associated grinding wheel formed thereby, and the fastener formed by the grinding wheel.

DETAILED DESCRIPTION

Figure 1:
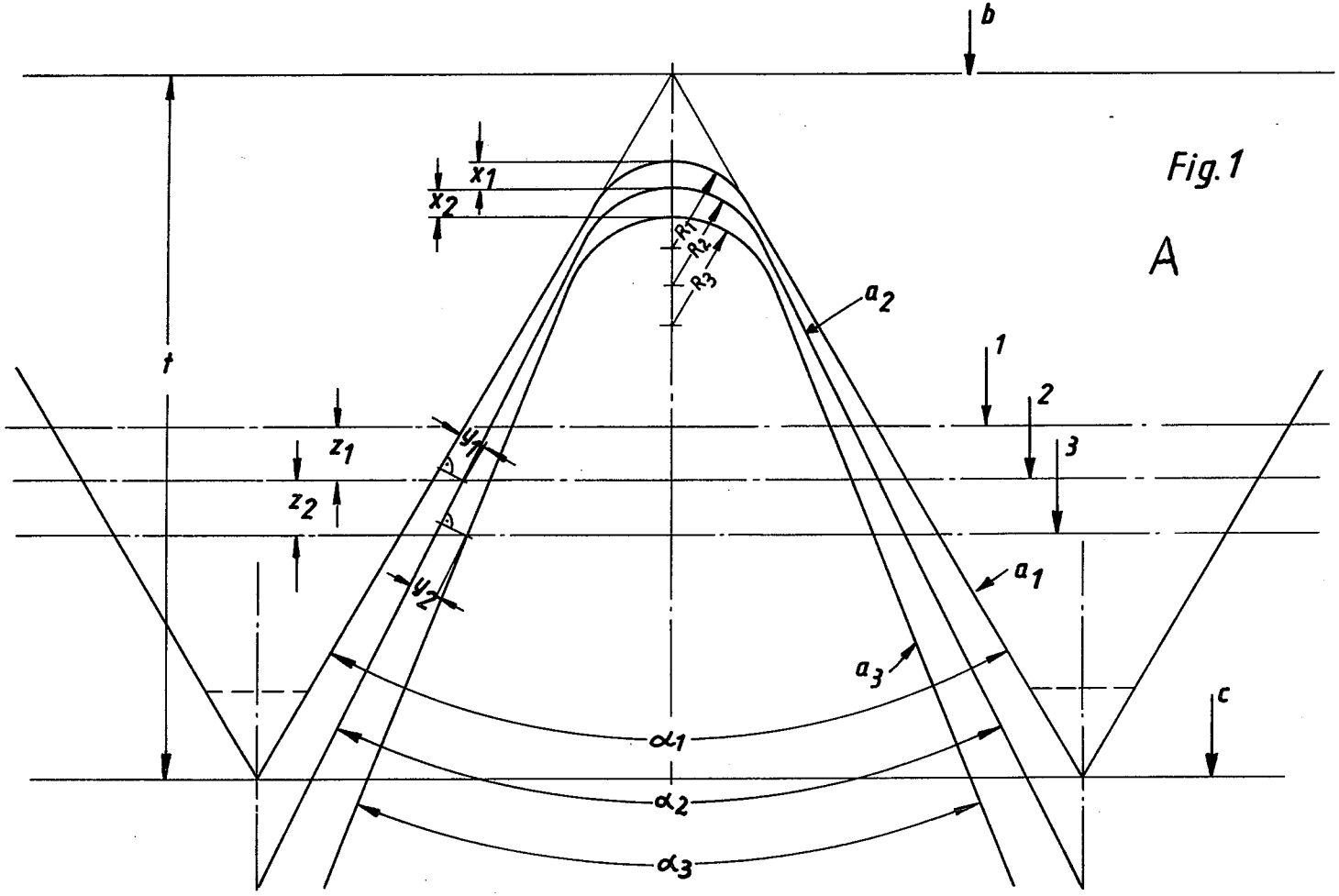

In FIG. 1 the inventive concept of the profile formation of a trimming roller A is shown, wherein three different profiles, namely the profile $a_1$ of the finishing roller rib, the profile $a_2$ of the preliminary roller ribs adjacent to the finishing roller rib, and the profile $a_3$ of further preliminary roller rib, are shown. These profiles are again reproduced in the roller A in FIG. 2*a*, showing that the preliminary roller ribs are arranged symmetrically on both sides of the finishing roller rib.

Figures 2A, 2B:
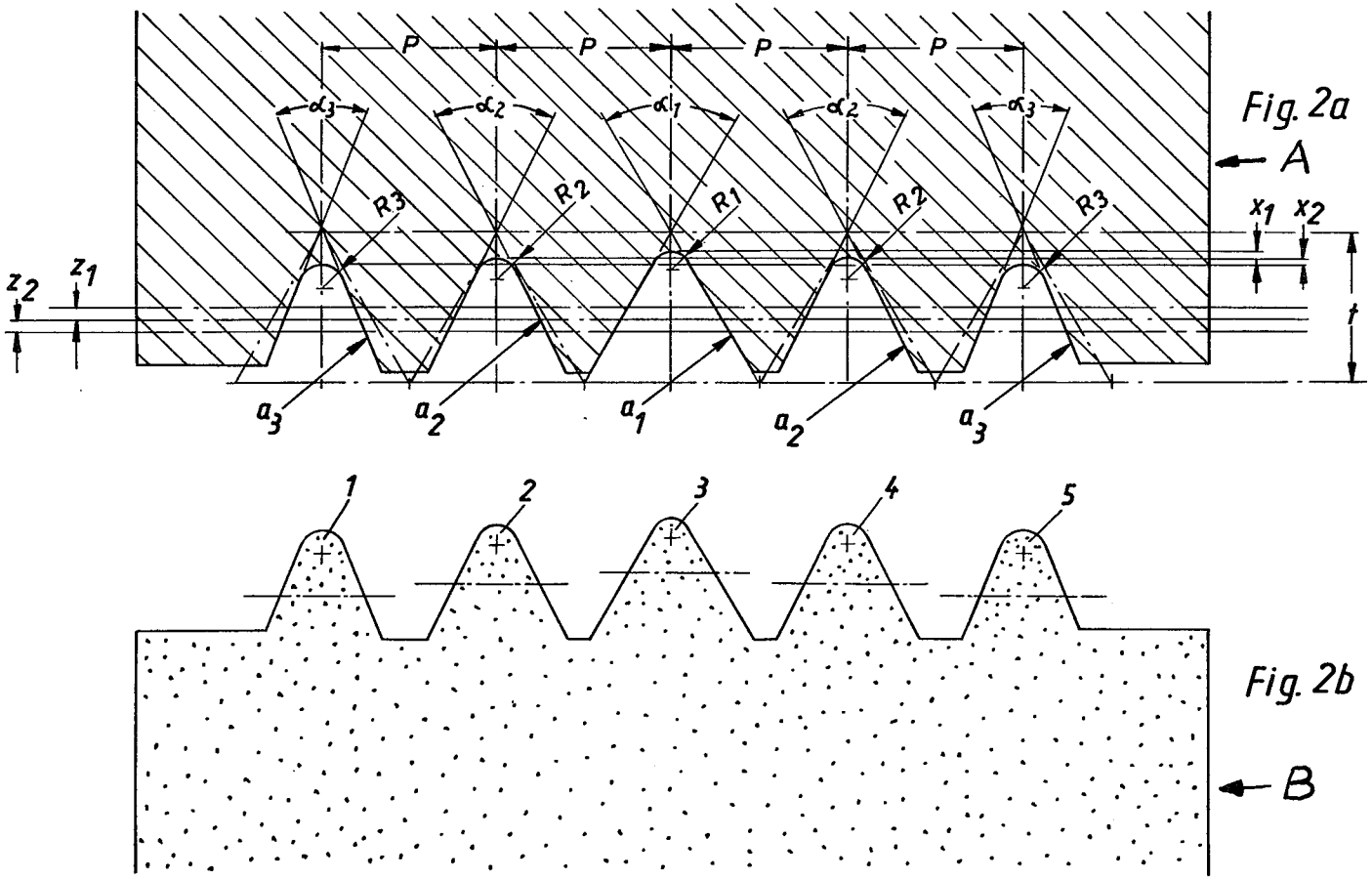

As can be seen from FIG. 1 the profile $a_1$ has a root radius $R_1$ which corresponds to the crest radius of the finishing grinding rib 3 of the grinding wheel B shown in FIG. 2*b*. The flanks of this profile form an angle $\alpha_1$. The pitch circle radius 1 of the finishing roller rib falls in the middle of the vertical spacing $t$ between the theoretical root radius $b$ and the theoretical outer radius $c$.

The profile $a_2$ of the preliminary roller ribs arranged symmetrically on both sides of the finishing roller rib, which correspond to the profile of the rough grinding ribs 2, 4 in FIG. 2*b* is formed in such a way that its root radius $R_2$ is greater than $R_1$ and its flank angle $\alpha_2$ is smaller than $\alpha_1$. In this profile $a_2$ the associated pitch circle radius 2 is selected greater than the pitch circle radius 1 by an amount $z_1$ wherein the amount $z_1$ is substantially doubly as large as the difference $x_1$ between the thread depth of the finishing roller rib and of the preliminary roller rib with the profile $a_2$. Herein both flanks of the preliminary roller ribs are rotated on the pitch circle 2 in such a way in relation to the corresponding flanks of the finishing roller rib that they form with one another the angle $\alpha_2 < \alpha_1$. The spacing $y_1$, shown in FIG. 1 results as the theoretical line, which thrusts from the intersecting point of the flanks with the associated pitch circle 2 as the perpendicular to the corresponding flanks of the finishing roll tooth. It is essential to the invention that the spacing $y_1$ is substantially equal to the spacing $x_1$.

The further profile $a_3$ of the preliminary roller rib, which corresponds to the profile of the rough grinding ribs 1 or 5 respectively of the grinding wheel B shown in FIG. 2, is for its part so constructed that its root radius $R_3$ is greater than the root radius $R_2$ of the neighboring preliminary roller rib and its flank angle $\alpha_3$ in turn is smaller than $\alpha_2$, since the flanks of this profile are in turn rotated on the associated pitch circle radius 3 in relation to the corresponding flanks of the neighboring preliminary roller rib. Also the pitch circle radius 3 is greater than the pitch circle radius 2 by an amount $z_2$, which amount $z_2$ is doubly as large as the difference $x_2$ between the thread depths of the neighboring preliminary roller ribs. The spacing $y_2$, which results exactly as has been described in relation to spacing $y_1$, corresponds in turn essentially to the difference $x_2$ between the thread depths of the neighboring preliminary roller ribs. In this, as illustrated in FIG. 2*a*, the spacing of the intersecting point between flank and pitch circle is equal to the spacing between the flanks of each tooth. The following relationships are illustrated:

$R_3 > R_2 > R_1$ $\alpha 1 > \alpha 2 > \alpha 3$ $y_1 \approx x_1$ $y_2 \approx x_2$ $Z_1/2 = x_1$ $Z_2/2 = x_2$ Accordingly $x_1$ and $x_2$ and $y_1$ and $y_2$ are of equal size.

Teeth 1 to 5 are produced by rolling the roller profile on the grinding wheel, which teeth are arranged symmetrically to one another, so that a forward and rearward grinding can be carried out with the grinding wheel.

The invention is not limited to a roller with only one finishing roller rib and two preliminary roller ribs arranged on each side of it.

The grinding surface of the roller according to the invention is provided with diamonds (not shown), in order additionally to optimize the tool life of the roller.

Figure 3:
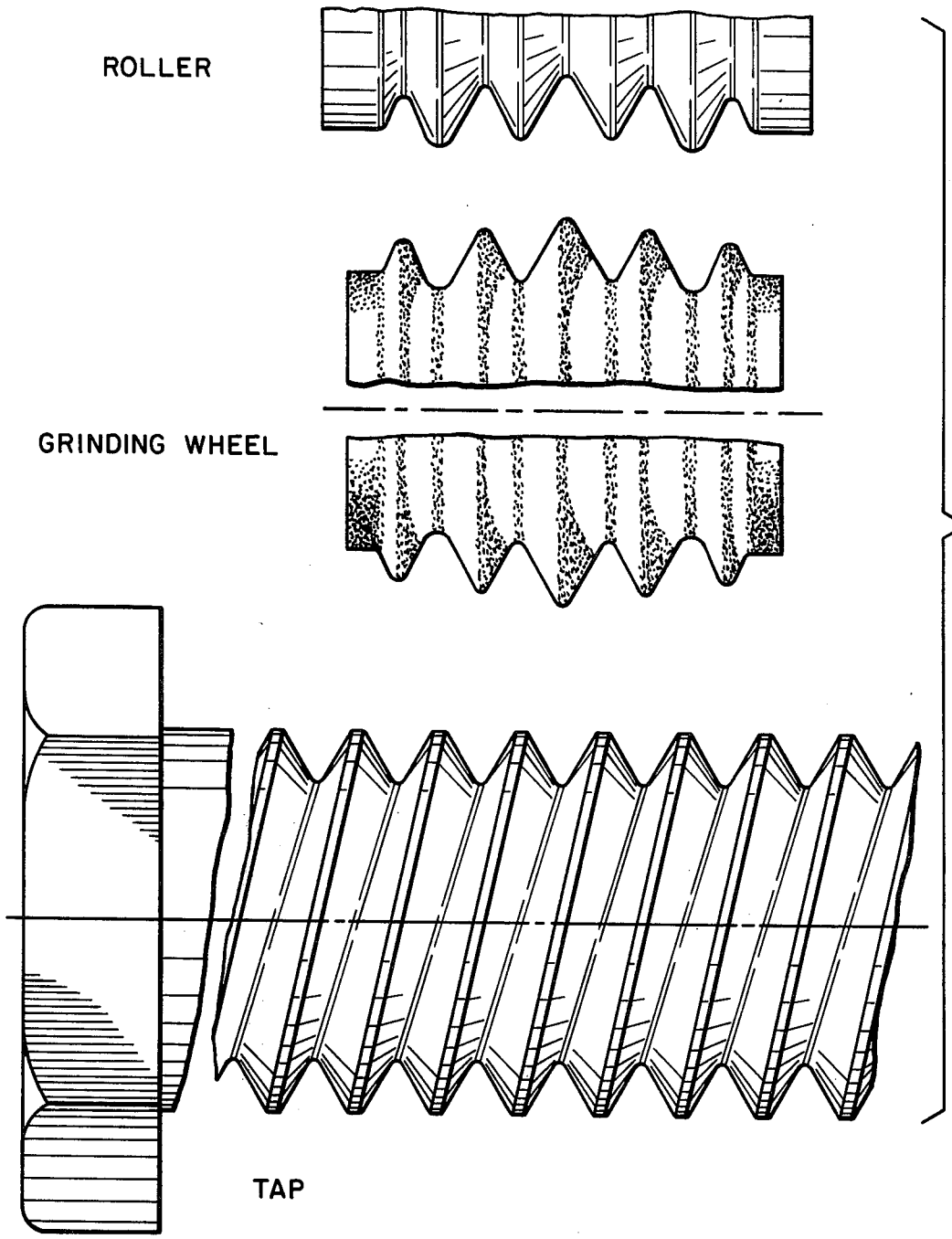

As shown in FIG. 3, the improved roller of the present invention is utilized to form a grinding wheel. This relationship of roller and grinding wheel was discussed with regard to FIGS. 2A and 2B. Once the grinding wheel is formed, it may be incorporated in a thread grinding machine to grind the threads on a fastener as represented schematically in FIG. 3. Note that the depth of the grooves of the roller varies, the maximum depth being represented as the distance *b* in FIG. 1. The maximum depth of the corresponding rib of the grinding wheel in FIG. 3 is likewise [represented by ] the distance *b*. The grinding wheel is then utilized to grind the threads of a fastener top having a constant thread depth *b*. [as shown in FIG. 3.--]

It is to be understood that the embodiment of the invention which has been described is merely illustrative of one application of the principles of the invention. Numerous modifications may be made to the disclosed embodiment without departing from the true spirit and scope of the invention.

What is claimed is:

1. A profiling roller for producing a profile on a grinding wheel for a thread grinding machine operating with longitudinal feed, said profiling roller comprising, in combination: at least one finishing roller groove in the center of the roller with a flank angle ($\alpha$1), root radius ($R_1$), pitch circle radius (1) and groove depth corresponding to the final thread form to the produced by the grinding wheel, and a plurality of modified preliminary roller grooves, said preliminary grooves being on each side of said finishing roller groove and having decreasing groove depth arranged symmetrically toward the opposite ends of the roller, the root radius ($R_2$, $R_3$) on the modified preliminary roller groove progressively increasing from groove to groove ($R_3 > R_2 > R_1$) and the flank angle progressively decreasing from groove to groove ($\alpha$3 $\alpha$2 $\alpha$1) towards the ends of the roller, the pitch circle radius of each successive preliminary roller groove, relative to the pitch circle radius of the next adjacent groove including the pitch circle radius of the finishing roller groove being progressively greater towards the ends of the roller such that the spacing measured from the intersecting point of the flank of each roller groove with its associated pitch circle at right angles to the corresponding flank of the next roller grooves arranged towards the roller ends, when grooves are projected over each other, is substantially equal to the groove depth difference of the next adjacent roller groove ($x_1 \cong y_1$; $x_2 \cong y_2$).

2. The roller of claim 1 wherein its active surfaces are provided with diamonds.

3. The roller of claim 1 wherein the difference in pitch circle radius of adjacent grooves is about two times the difference in depth of said grooves ($Z_1 = 2X_1$; $Z_2 = 2X_2$).

4. The roller of claim 1 having a grinding surface with diamonds.

5. The roller of claim 1 having a single center roller rib and one adjacent side rib on each side thereof.

6. The roller of claim 1 having a single center roller rib and a plurality of adjacent side ribs on each side thereof.

* * * * *